United States Patent [19]

Koehler

[11] 4,159,157

[45] Jun. 26, 1979

[54] MOLDED ELECTRICAL LAMP SOCKET AND METHOD OF CONSTRUCTION

[75] Inventor: Rudolph A. Koehler, Willowdale, Canada

[73] Assignee: Noma Lites Canada Limited, Scarborough, Canada

[21] Appl. No.: 879,262

[22] Filed: Feb. 21, 1978

[51] Int. Cl.[2] ..... H01R 13/38

[52] U.S. Cl. ..... 339/97 L; 339/117 R; 339/218 L

[58] Field of Search ..... 339/97 P, 99 P, 117 R, 339/218 L

[56] References Cited

U.S. PATENT DOCUMENTS

| | | | |
|---|---|---|---|
| 2,265,360 | 12/1941 | Dessart | 339/99 L |
| 3,716,818 | 2/1973 | Finkelstein | 339/97 L |

*Primary Examiner*—Joseph H. McGlynn

[57] ABSTRACT

Disclosed is a socket for an electric lamp including a receptacle for such lamp and terminals within the receptacle for making contact therewith; said socket being molded onto a power cord by clamping a zone of the power cord within a closed socket mold with the component wires of the cord separated and extending centrally across the socket cavity of the mold and being respectively impaled upon spikes protruding from the respective terminals to make electrical contact therewith; said terminals being disposed to extend across the socket cavity in a direction transverse to that of the power cord; the socket being molded with an integral partition extending between the separated wires and encapsulating them together with the spikes and parts of the terminals; pins being disposed between the separated wires at each side of the socket during the molding thereof, creating drain holes extending through the partition between the receptacle and the exterior.

6 Claims, 9 Drawing Figures

FIG.1.
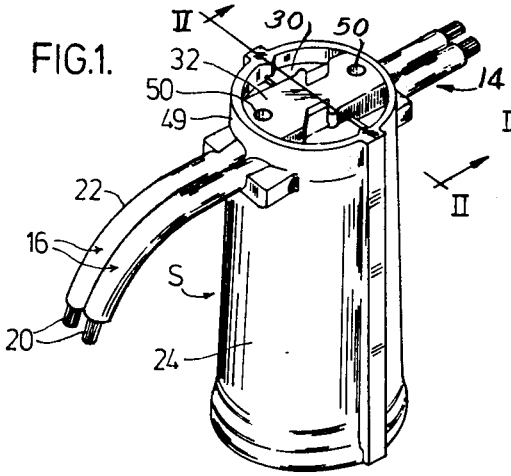
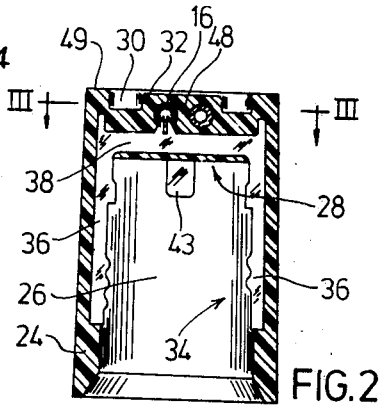
FIG.2.
FIG.3.
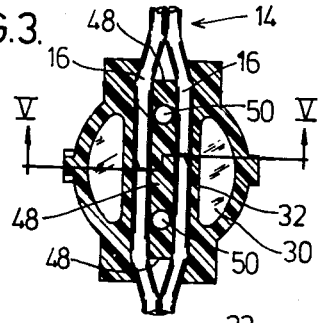
FIG.4.
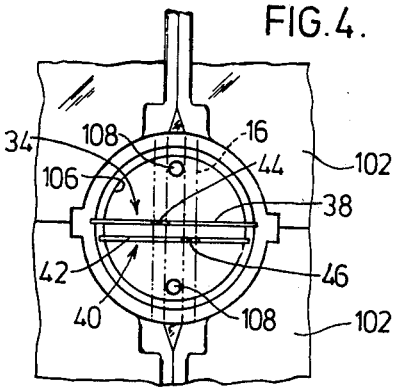
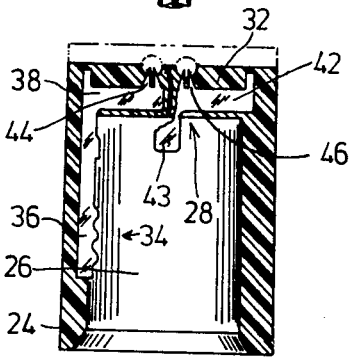
FIG.5.
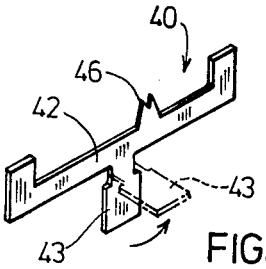
FIG.6.
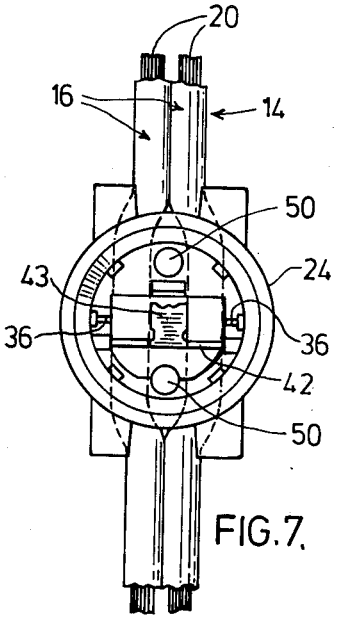
FIG.7.

MOLDED ELECTRICAL LAMP SOCKET AND METHOD OF CONSTRUCTION

FIELD OF THE INVENTION

The invention relates to electric lamp sockets molded onto electrical power cords and to the method of constructing them.

PRIOR ART

Related prior art comprises: LEITHISER—U.S. Pat. No. 2,502,860; TISCIONE—U.S. Pat. No. 2,605,317; GILBERT—U.S. Pat. No. 2,700,206; FRANCIS—U.S. Pat. No. 3,093,434; SORLIE—U.S. Pat. No. 3,444,618; FREEMAN British Pat. No. 995,697 and NOMA Canadian Pat. No. 1,014,240

BACKGROUND OF THE INVENTION

Letters Patent of Canada No. 1,014,240 granted to Noma Lites Canada Limited, discloses a lamp string assembly including a dual-wire power cord being, preferably, the well known ripcord with twin parallel wires; each including an electrical conductor in a penetrable insulating casing detachably bonded to the casing of the other wire, and at least one lamp socket molded onto an intermediate portion of the power cord.

The lamp socket has a shell or body molded of electrical insulating material including, a receptacle for the base of an electric lamp; a junction compartment coaxial and integral with the receptacle and within which the power cord is receivable and connected to the socket, and an integral partition separating the receptacle and the junction compartment. The terminals or current conductors of each socket extend from the junction compartment, through the partition, and into the receptacle to engage the base of a lamp installed therein and to make electrical connection therewith. A spike provided on each said terminal extends into the junction compartment where it impales one of the power cord wires so as to penetrate the insulating casing thereof and effect electrical engagement with the conductor containd therein.

Within the junction compartment the partition provides a dike which intervenes between the wires separating them from each other in the zone of their impalement upon the spikes; the said spikes together with the wires impaled thereon being also encapsulated by the partition.

The physical separation of the wires of the power cord has proven useful in discouraging arcing between them at the points of their impalement—particularly, in the presence of moisture and the prevention of arcing has been enhanced by erecting the dike aforesaid between them as well as by encapsulating the wires and spikes in the dielectric socket material in the junction compartment.

The patent aforesaid also shows it to be common to provide small holes in the socket for drainage of liquids —e.g. rain water—collecting in its receptacle portion.

The construction of the described socket is such as to adapt it to mass production techniques enabling efficient and economical manufacture of lamp string assemblies which are usually durable and relatively trouble free. However, certain problems have become manifest in connection therewith which the present invention seeks to obviate.

PRIOR ART

It will be recalled that the electrical connection between the power cord and the socket terminals is effected by impaling the wires of the power cord onto spikes protruding into the junction compartment from the respective socket terminals and one of the problems referred to concerns the pre-impalement alignment of the wires with their respective spikes and the maintenance of that alignment during the actual impalement and while the mold is being closed and injected.

It will be appreciated, that proper alignment is essential for a good electrical connection between each spike and the wire impaled thereon. During the closing of the mold, however, which is a high-speed operation, the previously separated and aligned wires seem to draw together and so to become misaligned with respect to the spikes upon which they are to be impaled. Since the tolerances are quite small, as will be understood, anything more than very minimal deviation may well be productive of poor electrical connection—hence, a defective socket or one with a materially reduced life span or, worse still, a possible fire hazard.

Another problem concerns the location of the drain holes—particularly in smaller sockets intended to accommodate small electrical lamps—e.g. candelabra-based lamp.

It will be appreciated that such drain holes are created by special (drain) pins provided in the socket mold; the drain holes being the voids left when the drain pins are withdrawn upon re-opening of the mold after completion of the molding operation. In small sockets, however, there are very few locations in the mold in which such drain pins will be out of the way to avoid interfering with or obstructing the manufacture of the socket.

This problem is aggravated by the use of heavy power cord in the manufacture of lamp string assemblies as is generally preferred for outdoor use.

OBJECTS OF THE INVENTION

Having regard to the foregoing, it is a main and general object of the invention to provide a mode of constructing a socket as aforesaid including provisions for maintaining the separation of the wires of the power cord to inhibit misalignment thereof during the molding of the socket and, secondly, to provide for drain holes in a manner which will create minimal interference with the construction of the socket. It is of course, a collateral object of the invention to provide an improved and more reliable socket constructed on a power cord as aforesaid.

SUMMARY OF THE INVENTION

The foregoing and other objects of the invention which will appear from the hereinafter following description of the elements, parts and principles which constitute it, are achieved by modifying the practice disclosed in the Canadian Pat. No. 1014,240 aforesaid by disposing the drain pins on the mold parts so as to intervene between the separated wires on opposite sides of the socket cavity. By this expedient, the separation and pre-alignment of the wires is maintained while the mold is closing and at the same time the voids or drain holes produced by the drain pins are aligned and spaced apart in the direction of the power cord.

In greater and more explicit detail, the invention subsists in training a power cord between the parts of an open mold in a position to be clamped therebetween when the mold is closed; the closed mold defining a socket cavity with a contained core centrally traversed by an intermediate zone of said power cord; mounting a pair of socket terminals to extend centrally and in spaced apart parallel relation across said core in a direction transverse to that of the power cord; said socket terminals having protruding spikes and being arranged on said core to dispose the spikes in diagonally offset relation to each other; separating the two wires of the power core in the zone aforesaid and aligning them for impalement upon the spikes of the respective terminals when the mold is closed; disposing drain pins between the wires on opposite sides of said socket cavity to maintain separation of the wires while the mold is closing, and molding, within said mold, a socket body with a partition intervening between the separated wires and encapsulating them together with the spikes upon which they are impaled and with drain holes through said partition communicating between the interior and exterior of the socket and spaced apart in a direction transverse to that of the terminals.

BRIEF DESCRIPTION OF THE DRAWINGS

Preferred forms of the invention will now be described by way of example only, with reference to the accompanying drawings wherein:

FIG. 1—is an isometric view of a socket attached to a short representative length of a power cord showing a side and the junction compartment of the socket;

FIG. 2—is a section along the line II—II of FIG. 1;

FIG. 3—is a plan view of the junction compartment of the socket, sectioned along the line III—III of FIG. 2;

FIG. 4—is a plan view of a part of the socket mold when closed in preparation for the molding of the socket;

FIG. 5—is a sectional view of the socket more or less similar to that of FIG. 2 but taken along the staggered line V—V of FIG. 3;

FIG. 6—is an isometric view of one of the socket terminals;

FIG. 7—is a plan view of the socket of FIG. 1 showing its interior construction;

THE PREFERRED EMBODIMENT

Figure 8:
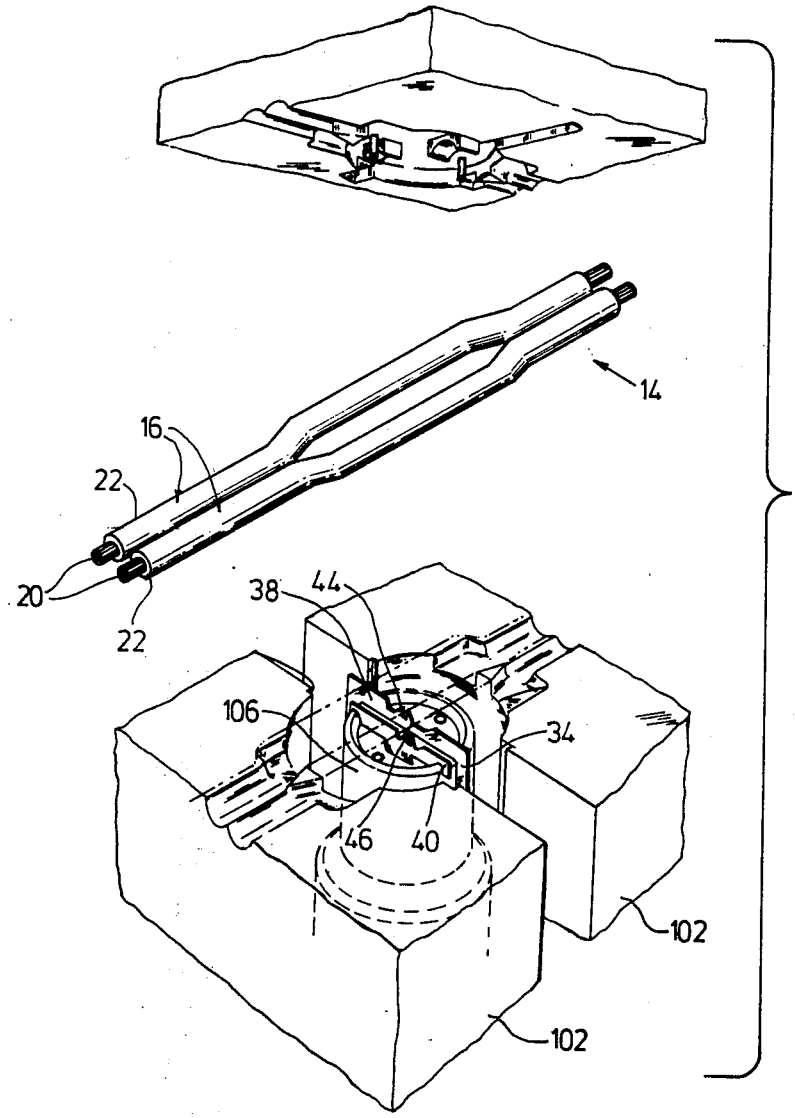
FIG. 8—is an exploded view of a mold suitable for the molding of a present socket, and FIG. 9—is a plan view of a portion of the mold in a position which is inverted from that of FIG. 8.
Figure 9:
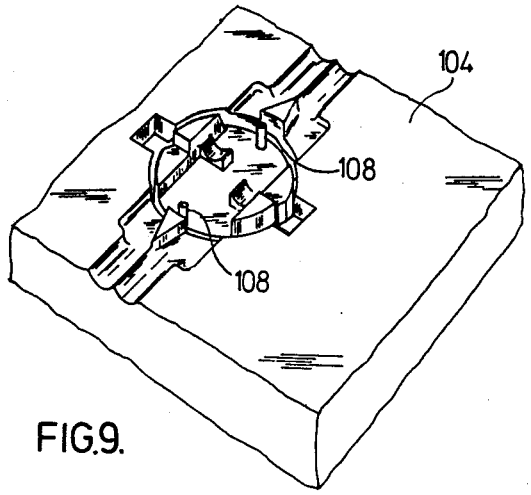

Referring once again to the drawings, a lamp string assembly as contemplated by the invention includes an electrical power cord 14 upon which a plurality of electric lamp sockets are assembled and constructed in spaced order. Lamp string assemblies of this nature being well-known, FIG. 1 illustrates only one such socket S on a short length of power cord 14. As will be apparent from this view, the preferred power cord 14 is of the parallel, dual type, sometimes known as a rip-cord, comprising wires 16—16; each having a stranded conductor 20 in an insulated casing 22 separably bonded to the casing 22 of the other wire 16.

Each lamp socket has a shell or body 24 surrounding and enclosing a receptacle 26 with conventional open and blind ends. In the mode illustrated in the drawing, the blind end of receptacle 26 is uppermost and, hence, referred to as its ceiling 28 above which there is a, so-called, shallow junction compartment 30 rimmed by an upward extension of the socket body 24 and largely occupied by a fairly massive partition 32 which also includes and is integral with the socket body 24 and its receptacle ceiling 28.

The electrically conductive parts of socket S include the yoke terminal 34 having two arms 36—36 suitably contoured to engage and make contact with the screw base (or equivalent) of an electric lamp; these arms 36—36 being partially embedded at diametrically opposite positions in socket body 24 and being joined by a web 38 embedded in partition 32 as shown in FIG. 2, for example.

For engagement with the central pole in a lamp, the invention provides a further terminal 40, best shown in FIG. 6 having a crossbar 42 which is also embedded in partition 32 and which has a tongue 43 projecting centrally from crossbar 42 into receptacle 26 as shown in FIG. 5.

In completed socket S, said tongue 43 is bent over at an acute angle to receptacle ceiling 28 for understood reasons; the tongue being initially co-planar with crossbar 42 as will appear from said FIG. 6.

It will be observed and it is noteworthy that the terminals 34 and 40 extend centrally across the socket S with their respective web 38 and crossbar 42 embedded in partition 32 in spaced apart, parallel, relation to each other. Spikes 44 and 46 on said web 38 and crossbar 42, respectively, extend upwardly therefrom into junction compartment 30 as in the split sectional view of FIG. 3.

Junction compartment 30 of socket S is also crossed centrally by power cord 14 but in a direction transverse to that of terminals 34 and 40 and, preferably, perpendicularly thereto; the wires 16—16 of the power cord 14 being laterally separated from each other within the junction compartment 30 and respectively impaled upon the terminal spikes 44 and 46 which are diagonally offset or staggered relative to each other to receive the separated wires 16—16 which are shown in phantom form in FIG. 4.

Also within the junction compartment 30, the wires 16—16 and the spikes 44 and 46 on which they are impaled are encapsulated in partition 32 which also provides a dike 48 between the separated wires 16—16 substantially as shown in FIGS. 1 and 2.

It need hardly be pointed out that the separation of the wires 16—16; the staggering of spikes 44–46; the dike 48 and the encapsulation aforesaid are collectively intended to inhibit sparking and shorting of the terminals and wires in junction compartment 30.

As has been mentioned and will be apparent from the drawing in any case, the partition 32 occupies virtually the entire junction compartment 30; its respective ends merging at opposite sides of the socket S with wall 49 being the specific upward extension of socket body 24 which rims the junction compartment 30.

The partition 32 is pierced through at each of its ends by a drain hole 50 intervening between the separated wires 16—16 and being disposed adjacent the wall 49. As viewed on the interior of socket S, (FIG. 7) the two drain holes 50—50 are, accordingly, spaced apart in a line which is co-directional with the power cord 14 and transverse to the direction of socket terminals 34 and 40; this being also apparent from FIG. 4.

Effectively, this places the drain holes 50—50 in the least congested regions of socket S as will be obvious from FIG. 8.

The described socket S is capable of being constructed by high speed production techniques which are relatively well-known in the plastic molding art.

That is to say, once wires 16—16 of power cord 14 have been impaled upon a pair of terminals 34–40, completion of socket S requires only the molding of a socket body 24 around them as described. From this, it follows logically that any number of successive sockets S can be assembled and constructed at spaced intervals on power cord 14 which can then be finished off in any preferred manner.

A mold M suitable for constructing successive sockets S as herein visualized is illustrated in exploded form in FIG. 8; ostensibly, intermediate closed and open positions. As will be seen, the mold M is comprised, essentially, of four parts, namely, the two laterals 102—102 which are brought together in the closed position of mold M (see FIG. 4) and separated in its open position; the raised top or cap portion 104 which is lowered and seated on the laterals 102—102 in their closed position, and core 106 which is axially movable in the cavity defined by the closed mold laterals 102—102 in the usual manner and for the usual purposes.

A preferred closing sequence of mold M is that the laterals 102—102 close first after which they are topped by the cap portion 104 which is then lowered, thereon followed by the upward thrust of the core 106 between the laterals 102—102.

Thus, to construct a socket S on power cord 14, an intermediate reach thereof in which its wires 16—16 have been separated is trained and stretched between the cap portion 104 above and the laterals 102—102 below it as suggested by FIG. 8. The mold parts then commence their described closing sequence in the course of which, power cord 14 is pressed down and clamped between the parts of the mold M while its cavity is traversed centrally in one direction by the separated wires 16—16 of power cord 14. Conversely, the terminals 34–40 are pre-loaded on core 106 so that their respective web 38 and crossbar 42 will be disposed to extend centrally across and on the mold core 106 in spaced parallel relation to each other with their respective spikes 44–46 diagonally offset in relation to each other; the direction in which terminals 34–40 extend across core 106 being transverse to the direction pursued by power cord 14.

This will be apparent from the composite view of FIG. 4 in which the mold laterals 102—102 are shown as closed with the mold core 106 sandwiched between them. Drain pins 108—108 have been added to this view between the separated wires 16—16 appearing in dotted lines; the staggered relationship of spikes 44–46 and the transverse relationship between separated wires 16—16 and terminals 34–40 being also illustrated.

Thus, it is provided and it will be seen that, having regard to the transverse relationship of the power cord 14 on the one hand and the terminals 34–40 on the other, the herein specified location of drain pins 108—108 virtually ensures that they will intervene between separated wires 16—16 which, in turn, is exceedingly helpful in maintaining such separation and, hence, in ultimately procuring fair impalement of wires 16—16 on the terminals 34–40.

In itself, this expedient has proven significantly effective and valuable in reducing the incidence of socket rejection encountered in the manufacture of lamp string assemblies as herein described.

Additionally—and surprisingly—, the same expedient also permits the formation of drain holes 50—50 in uncongested regions of socket S which is particularly beneficial to small sockets with heavy outdoor wiring; enabling the use of such sockets in exposed locations for which they were not hitherto available.

What I claim is:

1. A lamp string assembly including a power cord composed of parallel wires respectively having conductors in penetrable casings detachably bonded together and at least one electric lamp socket molded onto a zone of the power cord in which said wires are separated; said lamp socket comprising:

a body molded of electrical insulating material and including a receptacle for the base of said electric lamp;

a junction compartment co-axial and integral with the receptacle traversed centrally by said power cord zone;

an integral partition for the receptacle within the junction compartment;

terminals within the receptacle for engaging and making electrical contact with an electric lamp base installed therein;

cross members on the respective terminals embedded in said partition and extending centrally across said junction compartment in spaced apart parallel relation to each other and in a direction transverse to the direction in which the junction compartment is traversed by the power cord;

spikes projecting from the respective cross members disposed in diagonally offset relation to each other, each said spike impaling one of the wires of the power cord and making electrical contact with the conductor thereof;

a dike between the wires of the power cord within said junction compartment, said dike, wires, and spikes being encapsulated in said partition, and drain holes at opposite ends of the partition extending therethrough between the separated wires of the power cord.

2. A lamp string assembly as set forth in claim 1 wherein the cross members of the terminals extend across the junction compartment in a direction substantially perpendicular to that in which its junction compartment is traversed by the power cord.

3. Method of constructing an electric lamp socket on a parallel wire power cord comprising the steps of:

training said power cord between parts of an open mold in a position to be clamped therebetween when the mold is closed, the closed mold defining a socket cavity with a contained core centrally traversed by an intermediate zone of said power cord;

mounting socket terminals to extend centrally and in spaced apart parallel relation across said core in a direction transverse to that of the power cord, said socket terminals having protruding spikes and being arranged on said core with their spikes in diagonally offset relation to each other;

separating the wires of the power cord in the zone aforesaid and aligning them for impalement upon the spikes of the respective terminals when the mold is closed;

providing pins on said mold to intervene between the separated wires on opposite sides of said socket cavity and to maintain separation thereof while the mold is closing;

closing the mold, procuring impalement of said separated wires on said spikes, and molding, within said closed mold, a socket body with an integral partition intervening between the separated wires and encapsulating them together with the spikes upon which they are impaled and parts of the terminals.

4. Method of constructing an electric lamp socket as set forth in claim 3 wherein the pins disposed to intervene between the separated wires are elongated providing drain holes communicating between the interior and exterior of the socket.

5. Method of constructing an electric lamp socket as set forth in claim 3 including forming drain holes through said partition communicating between the interior and exterior of said socket and spaced apart in a direction substantially perpendicular to that of the terminals.

6. A method of constructing an electric lamp socket as set forth in claim 4 wherein the pins are disposed to provide said drain holes in a line which is perpendicular to the direction in which the terminals extend across said core.

* * * * *